US009440426B2

(12) United States Patent
Westby

(10) Patent No.: US 9,440,426 B2
(45) Date of Patent: Sep. 13, 2016

(54) INK PROOFING SYSTEM

(71) Applicant: PROBITY ENGINEERING, LLC, Milaca, MN (US)

(72) Inventor: Ronald K. Westby, Princeton, MN (US)

(73) Assignee: Probity Engineering, LLC, Princeton, MN (US)

( * ) Notice: Subject to any disclaimer, the term of this patent is extended or adjusted under 35 U.S.C. 154(b) by 0 days.

(21) Appl. No.: 14/642,108

(22) Filed: Mar. 9, 2015

(65) Prior Publication Data

US 2015/0210059 A1 Jul. 30, 2015

Related U.S. Application Data

(63) Continuation of application No. 12/510,789, filed on Jul. 28, 2009, now Pat. No. 8,973,497, which is a continuation-in-part of application No. 12/104,110, filed on Apr. 16, 2008, now Pat. No. 8,720,335.

(60) Provisional application No. 61/084,131, filed on Jul. 28, 2008, provisional application No. 60/925,974, filed on Apr. 24, 2007, provisional application No. 60/964,870, filed on Aug. 15, 2007.

(51) Int. Cl.

| | |
|---|---|
| ***B41K 1/38*** | (2006.01) |
| ***B41K 3/54*** | (2006.01) |
| ***B41F 5/20*** | (2006.01) |
| ***B41F 31/00*** | (2006.01) |

(52) U.S. Cl.

CPC ..... *B41F 5/20* (2013.01); *B41F 31/00* (2013.01); *B41P 2200/12* (2013.01)

(58) Field of Classification Search

CPC ..... B41F 5/20; B41F 31/00; B41P 2200/12

See application file for complete search history.

(56) References Cited

U.S. PATENT DOCUMENTS

| | | | | |
|---|---|---|---|---|
| 4,004,509 | A * | 1/1977 | Moss | 101/216 |
| 4,019,434 | A * | 4/1977 | Hoexter | 101/216 |
| 4,258,125 | A * | 3/1981 | Edhlund | 430/293 |
| 4,586,978 | A * | 5/1986 | Kondo et al. | 156/540 |
| 5,410,961 | A * | 5/1995 | DeNicola et al. | 101/363 |
| 5,495,800 | A * | 3/1996 | Weissbein et al. | 101/329 |
| 5,826,509 | A * | 10/1998 | Deneka | 101/366 |
| 5,967,041 | A * | 10/1999 | Schoenert et al. | 101/329 |
| 6,006,665 | A * | 12/1999 | Stuchlik et al. | 101/352.13 |
| 6,360,660 | B1 * | 3/2002 | Allison, Jr. | 101/169 |
| 6,378,426 | B1 * | 4/2002 | Furr et al. | 101/329 |
| 6,422,143 | B1 * | 7/2002 | Lawrence et al. | 101/216 |
| 6,629,496 | B1 * | 10/2003 | Boose et al. | 101/363 |
| 6,718,873 | B1 * | 4/2004 | Sambri et al. | 101/375 |
| 2002/0134261 | A1 * | 9/2002 | Detmers et al. | 101/216 |
| 2003/0051618 | A1 * | 3/2003 | Westby et al. | 101/335 |
| 2003/0084802 | A1 * | 5/2003 | Goldburt et al. | 101/351.1 |
| 2003/0217662 | A1 * | 11/2003 | Koifman et al. | 101/484 |
| 2005/0241504 | A1 * | 11/2005 | Westby | 101/218 |
| 2005/0243154 | A1 * | 11/2005 | Westby et al. | 347/101 |
| 2006/0102029 | A1 * | 5/2006 | Westby | 101/335 |
| 2010/0005985 | A1 * | 1/2010 | Westby | 101/218 |

* cited by examiner

*Primary Examiner* — David Banh

(74) *Attorney, Agent, or Firm* — Skaar Ulbrich Macari, P.A.

(57) ABSTRACT

An ink proofing system may include a hand holdable support member, an anilox roll coupled to the support member and an impression roll coupled to the support member. A photopolymer printing plate with an etched outer surface can be coupled to the outer circumferential surface of the impression roll. An adjustment device coupled to the support member can be provided to set a fixed nip between the printing plate and the ink-receiving substrate.

10 Claims, 16 Drawing Sheets

Fig. 19

| | VIGNETTE WITHOUT IR | VIGNETTE WITH IR | DOT PATTERN MARK ANDY PRESS | DR-100 |
|---|---|---|---|---|
| | 0.04 | 0 | 0.19 | 0 |
| | 0.02 | 0 | 0.19 | 0.03 |
| | 0.05 | 0.01 | 0.21 | 0.01 |
| | 0.05 | 0.02 | 0.2 | 0.04 |
| | 0.05 | 0.02 | 0.19 | 0.01 |
| | 0.06 | 0.01 | 0.21 | 0.02 |
| | 0.07 | 0.02 | 0.2 | 0.01 |
| | 0.03 | 0.02 | 0.22 | 0.06 |
| | 0.01 | 0.04 | 0.2 | 0.04 |
| | 0.05 | 0.02 | 0.2 | 0.05 |
| | 0.05 | 0.01 | 0.24 | 0.02 |
| | 0.05 | 0.02 | 0.21 | 0.04 |
| | 0.06 | 0.05 | 0.18 | 0.03 |
| | 0.04 | 0.02 | 0.23 | 0.05 |
| | 0.06 | 0.02 | 0.21 | 0.04 |
| | 0.04 | 0.02 | 0.2 | 0.02 |
| | 0.03 | 0.01 | 0.22 | 0.1 |
| | 0.03 | 0.04 | 0.22 | 0.02 |
| | 0.07 | 0.04 | 0.23 | 0 |
| | 0.06 | 0.02 | 0.22 | 0.02 |
| STANDARD DEVIATION | 0.016026294 | 0.013168943 | 0.015652476 | 0.023502519 |

INK PROOFING SYSTEM

PRIORITY

This application is a continuation of application Ser. No. 12/510,789 filed Jul. 28, 2009, which in turn is a Continuation in Part of U.S. patent application Ser. No. 12/104,110 filed Apr. 16, 2008, which claims the benefit of U.S. Provisional Patent Application 60/925,974 filed Apr. 24, 2007 and U.S. Provisional Patent Application 60/964,870 filed Aug. 15, 2007, and application Ser. No. 12/510,789 also claims the benefit of U.S. Provisional Patent Application 61/084,131 filed Jul. 28, 2008. Each of the foregoing applications is hereby fully incorporated herein by reference.

FIELD

The present invention relates generally to the field of flexographic printing and, more particularly, to portable flexographic ink proofing apparatus, systems and methods for providing proofs of ink samples.

BACKGROUND

In the field of flexographic printing ink samples may be obtained by drawing ink over a substrate using a hand ink proofer or by more sophisticated proofing methods. In hand proofing ink is applied to the substrate by manually rolling the hand proofer across the substrate. Manual ink proofer tools are utilized for proofing ink colors in an effort to accurately predict the results to be obtained by running a selected ink specimen in a printing press. A computer microscope or other instrument is then used to examine the ink smear on the substrate. The computer then indicates to the technician various color components to be added to the ink in order to achieve the desired ink coloration.

In a flexographic printing operation, resilient plates are utilized for delivering the ink to the substrate. Substrates generally include the stock or paper to be printed but may also include plastic and many other materials.

The shade of a color on a flexographic printing press is dependent on the thickness of the ink film applied to the substrate or stock. The ink film thickness is determined by the speed of the press, the pressure applied between the printing plate and paper (i.e., impression), and the pressure between the rollers on the printing unit.

U.S. Pat. No. 6,814,001 describes an ink proofer designed to overcome the problems associated with conventional manual proofer tools by generating consistent and reliable ink draws using a hand-held proofer tool retained in a movable mounting assembly. A variable pressure system is coupled to the mounting assembly to move the proofer tool into a contact position with a cylindrical drum. The transfer roller of the proofer tool then transfers ink to a substrate inserted between the drum and the transfer roller of the proofer tool when a drive motor for the drum is engaged. U.S. Pat. No. 6,814,001 is hereby incorporated by reference.

Printing presses generally use an anilox roll to meter ink and a cylinder bearing an engraved plate to transfer the ink from the anilox roll and to deposit it onto the substrate as a printed image. The substrate commonly includes paper but may also include many other materials such as plastic bags or any other material onto which printing may be applied.

The engraved plate may be made to include both solid and/or dot patterns depending upon image requirements. For a single color image, typically a plate with a solid or smooth surface may be used. For a multi-color image where more than one color is required a dot pattern is generally used. The superimposition of multiple dot patterns onto a substrate is used to print multi-color images. Typically each dot pattern is printed with a primary color onto the substrate. By putting the substrates through multiple passes in the press, any shade or color may be created by the combination of primary colors.

To obtain the desired colors in multi-color materials however, each primary color must print correctly and be of the correct density. Therefore, when adjusting inks for color, it is the primary color in each dot pattern that must be controlled.

Current proofing processes only use an anilox in a transfer roll to lay down ink. This process creates a smear of ink that proofs its color and density. The transfer roll duplicates the volume of the ink in the anilox and color, but does not duplicate the dot percentage pattern found in an offset plate. The dot percentage pattern is based on the proportion of the substrate that is covered with ink. Small dots result in a smaller percentage of coverage than large dots.

Printing plates can be and often are tested on the printing press but the expense of doing so is high. Modern printing presses are expensive. Any time that is used to test on the press is non productive time and cannot be used for profitable production. A printing press requires considerable time for setup and cleanup in addition to the time that is used in a test run. In addition, modern printing presses operate at high speed and can consume large quantities of ink and substrate quickly adding to the expense of testing.

Thus, there is still room for improvement in the preparation of proofing printouts in order to provide the best results in a printing press. While current proofing techniques are helpful in preparing for production printing press runs they are not adequate to predict the performance of the printing press.

A standard flexographic printing press has four main components:

1. A metering roll. This roll rotates in an ink well, wherein ink adheres to its surface. The ink well is necessarily located below the metering or inking roll because of gravity. As such the metering roll is located below and in contact with the anilox roll. As the metering roll rotates, it contacts the anilox roll and squeezes the ink into the anilox cells.
2. The anilox rotates, laden with ink, to the doctor blade.
3. The doctor blade is located near the metering roll, and presses against the anilox, and also is positioned with the edge "leading" (or cutting) into the anilox. This position shears the excess ink from the anilox and, usually, returns it to the ink well via gravity.
4. The photopolymer plate or other printing plate then receives the ink from the anilox and transfers it to the substrate.

A conventional hand proofer has three components:

1. An anilox which transfers metered ink from the doctor blade to the transfer roll or photopolymer plate.
2. A doctor blade located near the top of the anilox and positioned with its edge trailing (creating wiping action). This wiping action is necessary because ink needs to be forced into the anilox before metering it. So a trailing edge anilox services two purposes, forcing ink into anilox and metering it level to the anilox surface. These two actions compromise each others' ability to perform. The wiping action of the trailing blade tends to lift the doctor blade, allowing non-metered ink to pass. This non-metered amount of ink reduces accuracy of ink application and reduces the quality and consistency of the resulting proof.

3. An ink transfer roll that receives ink from the anilox and applies an ink sample to the substrate.

SUMMARY

The present invention solves many of the above-discussed problems. In one aspect, the invention is a proofing tool including an anilox roll, and a transfer roll.

The invention includes a transfer or transfer roll that includes a printing plate similar to that used on a flexographic printing press. The printing plate may include for example a photopolymer printing plate.

The transfer roll and the anilox roll are shiftable relative to each other between an engaged position where the transfer roll is engaged with the anilox roll and a disengaged position where the transfer roll is disengaged from the anilox roll. An anilox support member supports the anilox roll and a transfer support member supports the transfer roll such that the anilox roll and the transfer roll are oriented substantially parallel and separated by a nip distance. The invention may also include a positive rotational linkage between the anilox roll and the transfer roll so that the pitch velocity of the anilox roll and the pitch velocity of the transfer roll are substantially matched.

The invention includes a proofing tool, having an anilox roll and a transfer roll. The transfer roll and the anilox roll are shiftable relative to each other between an engaged position where the transfer roll is engaged with the anilox roll and a disengaged position wherein the transfer roll is disengaged from the anilox roll. The invention further includes an anilox support member supporting the anilox roll and a transfer support member supporting the transfer roll such that the anilox roll and the transfer roll are oriented substantially parallel to one another and separated by a nip distance. The invention may also further include a positive stop nip adjustment mechanism operably connected to the anilox roll and the transfer roll which is adjustable so that when the anilox roll and the transfer roll are in the engaged position the positive stop prevents the nip distance from being smaller than a set value.

The invention may also further include a positive stop nip adjustment mechanism operably connected to the proofing tool and a proofing machine such that nip between the transfer roll and the drive roller of the proofing machine which is adjustable so that when the transfer roll and the drive roller of the proofing machine are in the engaged position the positive stop prevents the nip distance from being smaller than a set value.

In another aspect, the invention includes a gear driven anilox proofing tool with a positive stop adjustment of nip distance the anilox roll and the transfer roll or the transfer roll and the drive roller of the proofing machine. The present invention includes a proofing tool that has a positive rotating connection between the anilox roller and the transfer or transfer roller so that no matter how light the nip pressure is the speed of the rollers remains matched. The positive rotating connection matches the pitch velocity of the anilox roll with the transfer roll whether the anilox roll and the transfer roll are of similar or varying diameters.

In addition, the present invention allows the nip of the proofing tool to closely simulate the nip of the printing press so that the shear properties of the ink are not affected significantly differently in the proofing tool than in the printing press, which would lead to variations in color, density and shade between the proof and the printed result. A gear drive between the anilox roll and the transfer roll prevents slipping between the anilox roll and the transfer roll. The gear drive also allows wider variation in pressure ratios without slipping.

The proofing tool of the present invention is also adapted for use with a proofing machine that has a drive roll. A typical proofing machine has a drive roll that is formed of rubber. Often, a drive roll is formed of 60 durometer rubber. The drive roll may have a polished metallic surface, a textured surface or a surface of another material. In an embodiment of the invention, the drive roll has a polished metallic surface in a center segment and resilient bands at the edges. For example the resilient bands may be formed or rubber or urethane. Materials of forty to sixty durometer may be suitable. The present invention creates positive or semi-positive drive between the drive roll of the proofing machine and the transfer roll of the hand proofer. For the purposes of this application, a positive drive will be considered a drive that has essentially no slippage between the transfer roller and the drive roller in the case of an automated proofing arrangement and the transfer roller and the surface that supports the substrate in the case of a hand proofing arrangement. In other words a positive drive in accordance with the present invention maintains the pitch velocities of the anilox roll and the transfer roll to be substantially equal. An exemplary positive drive includes a gear tooth engagement between the transfer roll and the drive roller or supporting surface. A semi-positive drive will be considered a drive that has limited slippage between the transfer roller and the drive roller in the case of an automated proofing arrangement and the transfer roller and the surface that supports the substrate in the case of a hand proofing arrangement. An exemplary semi-positive drive includes a high friction engagement between the transfer roll and the drive roller or supporting surface. For example, a gear rolling on a resilient rubber surface creates a semi-positive drive. A positive or semi-positive drive allows lighter nip pressure on the substrate even with high contact pressure between the anilox roll and the transfer roll.

This is particularly helpful for film drawdowns. In addition, the positive or semi-positive drive between the drive roll and the transfer roll allows for higher doctor blade pressures. The positive or semi-positive drive between the drive roll and the transfer roll may be accomplished by the gears on either side of the transfer roll engaging with the drive roll instead of the drive roll engaging the paper which then in engages the transfer roll by friction.

Another aspect of the present invention is that the nip is adjustable by positive displacement rather then by the application of variable spring pressure. In the present invention the nip is set by displacement adjustable by one or more micrometer thimbles built into the proofing tool. This allows for consistent, repeatable displacement between the anilox roll and the transfer roll and better approximates the nip of the printing press, thus allowing more reliable consistent proofing of the resulting material.

The hand proofer of the present invention may be operated manually or may be used with a proofing machine.

In another aspect, the present invention lends itself to particularly easy cleaning for removing inks to allow for multiple proofing of multiple color inks without significant delay.

Another benefit of the present invention is that it may be adapted to use readily available anilox rolls from multiple suppliers currently in the market.

Another aspect of the present invention is that when it is used for proofing, the anilox and transfer rolls are oriented in a vertical position relative to one another. This vertical orientation of the anilox roll above the transfer roll simulates the orientation found in a printing press so that the effect of gravity on ink in the cell structure of the anilox roll is similar to that found in the printing press. This provides for more reliable consistent proofing that is more comparable to the results that will be seen in the printing press when the actual print run is made.

The proofing tool of the present invention generally includes an anilox support, a transfer support, an anilox roll, a transfer roll and a positive roll drive. The anilox support and the transfer support are substantially parallel in substantially similar yoke shaped structures adapted to support the anilox roll and the transfer roll respectively. The anilox support and the transfer support are connected to one another at an end distal from the anilox roll and the transfer roll. The anilox support and the transfer support can flex relative to one another in a limited, controlled fashion.

The anilox roll and the transfer roll are supported in close proximity to one another on independent axles so that they can roll relative to one another. In one aspect of the invention, the anilox roll and the transfer roll are interconnected by an anilox gear and transfer gear. The anilox gear and the transfer gear mesh to provide a positive rotation of the anilox roll related to the transfer roll so that slippage cannot occur and pitch velocity is maintained equal between the two.

The anilox support and the transfer support are separated by a short gap and one or two micrometer thimbles are interposed so that the micrometer thimbles can be adjusted to accurately alter the spacing between the transfer support and the anilox support. The micrometer thimbles create a positive stop so that the distance between the anilox roll and the transfer roll, when they are engaged, can be precisely and repeatably set. The positive stop sets a minimum distance that can be achieved between the anilox roll and the transfer roll. Thus, the spacing between the anilox support and the transfer support may be repeatedly and precisely set.

In another aspect to the invention there may be a transfer gear located at each end of the transfer roll. Thus, when the proofing tool is used with a mechanical proofer the transfer gears on each side of the transfer roll engage with the drive roll to create a positive or semi-positive drive between the drive roll and the transfer roll.

The anilox roll and the transfer roll of the present invention are oriented so that, in use, they are in vertical position with the anilox roll above the transfer roll. This duplicates the arrangement in a printing press such that the effect of gravity on ink transfer between the anilox roll and the transfer roll is similar to that in a printing press producing more reliable and consistent proofs.

The present invention and engraved printing plate may be applied to the transfer or transfer roller of the proofer. The engraved plate may be made to include both solid and/or dot patterns depending upon ink and image requirements. For spot colors, those colors used for a single color image, typically a plate with a solid or smooth surface may be used. For process colors, colors that are used in a multiple color image, where more than one color is required, a dot pattern is generally used. The superimposition of multiple dot patterns onto a substrate in a printing press is used to print multi-color images.

The printing plate used in the present invention may include a photopolymer printing plate. In one embodiment of the invention, the photopolymer printing plate used on the proofing tool may be made simultaneously with or even as a portion of the same plate as a photopolymer printing plate that is used on the printing press for a particular printing job. The portion of the printing plate for use on the proofer can then be utilized to predict the performance of the printing plate on the printing press at much lower cost than that which would be required to test a printing plate on the printing press. In this way, performance of the plate on the press is highly predictable. It is possible to closely match both color density and dot gain, thereby predicting the performance of the plate on the printing press without the necessity or expense of doing a printing press run. When color density and dot gain are closely matched, for example within five percent, the appearance of the printed result is indistinguishable to all but the most careful and experienced observer.

In another embodiment, the present invention includes a method of predicting the performance of a printing plate on a printing press including preparing a printing plate for the printing press simultaneously or in parallel with a printing plate for a proofing device. The proofing plate is mounted on the proofing device. Optimization of performance of the printing plate on the proofing device is achieved by adjusting to achieve minimum ink transfer from the anilox roller to the printing plate and minimum ink transfer from the printing plate to the substrate. A printing proof is prepared and the proof is evaluated for characteristics including dot gain and color density. This information is used to adjust the parameters of the printing plate, if required. An adjusted printing plate is prepared and the process repeated. This allows the printing technician to set up the printing press to optimize the performance of the printing press plate on the printing press while also minimizing printing press downtime and maximizing printing press run time.

In another aspect of the invention, the photopolymer plate on the proofing tool is utilized to predict the performance of the ink, the combination of ink, photopolymer and sticky back adhesive that is used to secure the printing plate to the transfer roll.

Printing plates can be and commonly are tested on the printing press, but the expense of doing so is very high. A modern printing press can cost upward $300,000.00, and uses large quantities of substrate and ink in a relatively short time. In addition, the time required to clean and adjust the printing press can be substantial. Thus, printers would prefer to have the printing press operating doing production work as much of the time as possible. Any press time that is used in testing plates, ink or combinations of plates, ink and the sticky back adhesive that is used to secure the plates is time that is unavailable for press production activities.

If after proofing a plate on the proofing device it is necessary to make adjustments in the plate, adjustments in the plate can be made and the new adjusted plate proofed on the proofing device without the expense of set-up and clean-up and other necessary expenses involved in proofing the plate on the printing press.

BRIEF DESCRIPTION OF THE DRAWINGS

FIG. 19 is a table listing the density measurements recorded for each ink color density measurement in FIG. 18 along with standard deviation calculations.

DETAILED DESCRIPTION

Figure 1A:
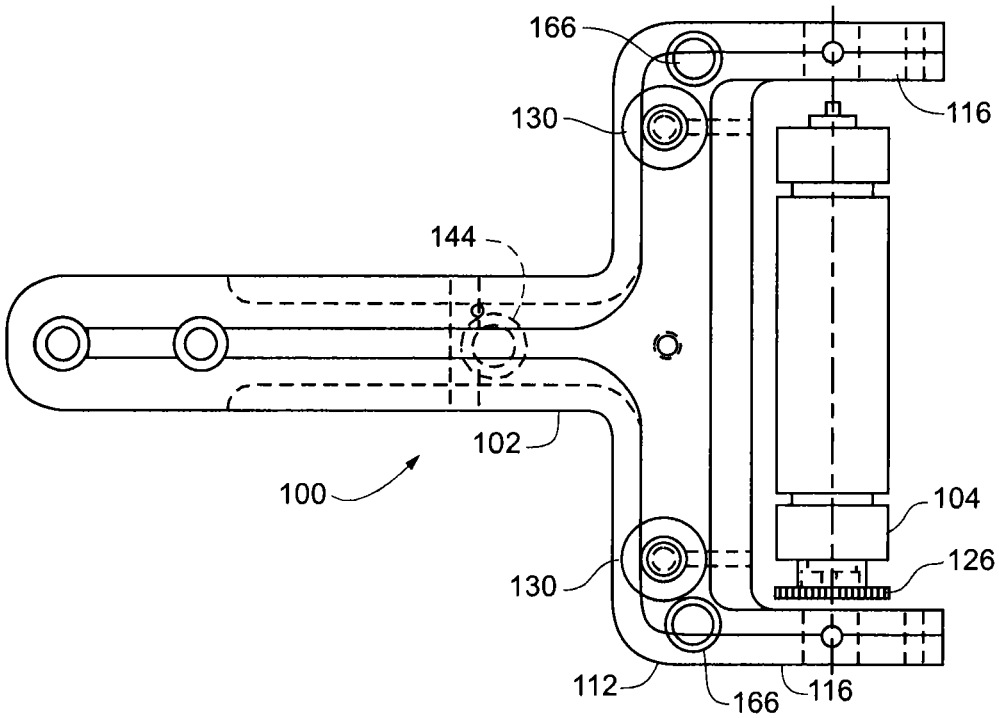
FIG. 1A is a plan view of an embodiment of a proofing tool in accordance with the invention with some structures shown in phantom and some parts removed for clarity.

Referring to FIGS. 1-4 proofing tool 100 generally includes anilox support 102, transfer support 104, anilox roll 106, transfer roll 108 and positive roll drive 110. Anilox support 102 and transfer support 104 are similar but not identical structures. Proofing tool 100 includes a doctor blade that is not shown in FIGS. 1-3 for clarity. An exemplary doctor blade and pressure bar are depicted in FIGS. 4, 5-7 and 9-10.

Anilox support 102 generally includes yoke 112 and extended portion 114. Yoke 112 supports anilox roll 106 between two arms 116. Likewise, transfer support 104 includes yoke 122 and extended portion 124. Anilox roll 106 and transfer roll 108 are supported between the arms of yoke 112 and yoke 122 respectively. Anilox support 102 and transfer support 104 are connected only at distal end 125 of extended portions 120 and 124. Otherwise, anilox support 102 and transfer support 104 are oriented substantially parallel with a small gap between them. Transfer support 104 is capable of some flexing movement from a disengaged position to an engaged position such that transfer roll 108 is held slightly more separated from anilox roll 106 when no force is applied to transfer roll 108 than when transfer roll is in contact with a printing substrate.

Figure 3:
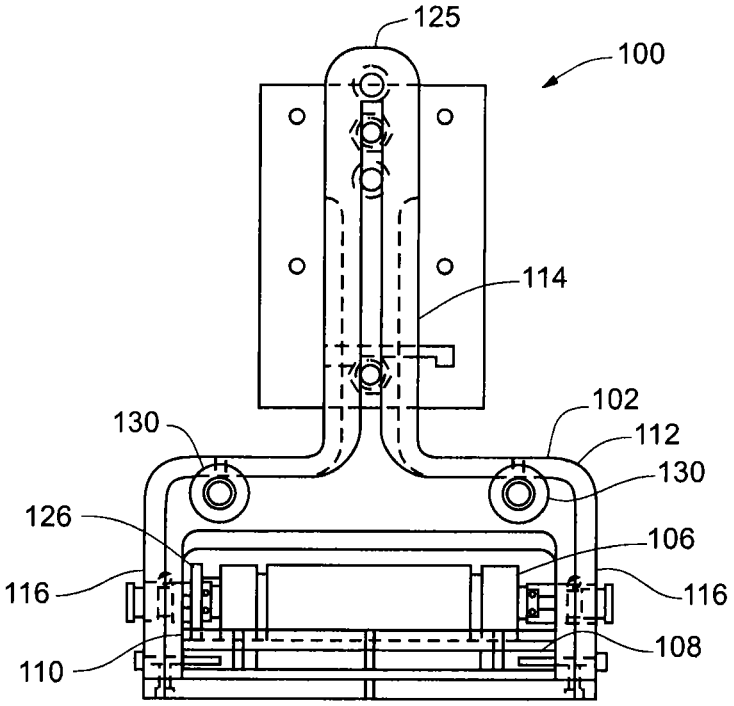
FIG. 3 is a plan view of an embodiment of a of a proofing tool in accordance with the invention.
Figure 4:
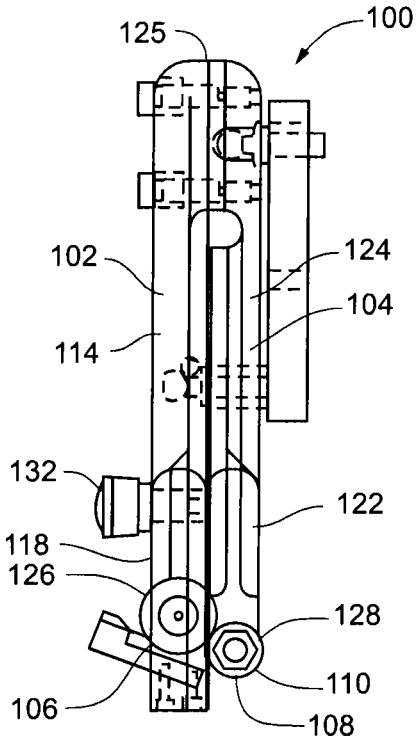
FIG. 4 is an elevational view of an embodiment of a of a proofing tool in accordance with the invention.

Positive roll drive 110 generally includes anilox gear 126 and transfer gear 128. As best seen in FIGS. 3 and 4, anilox gear 126 and transfer gear 128 mesh together to synchronize the motion of anilox roll 106 and transfer roll 108. In one embodiment of the invention, there is a single set of anilox gear 126 and transfer gear 128. Another embodiment of the invention includes one anilox gear 126 and two transfer gears 128. If one anilox gears 126 and two transfer gears 128 are present, one anilox gear 126 is located on one end of anilox roll 106 and two transfer gears 128 are located on each end of transfer roll 108 respectively.

Proofing tool 100 also includes one or more micrometer thimbles 130. Two micrometer thimbles 130 may be used to allow independent adjustment to ensure equal nip spacing across the width of anilox roll 106 and transfer roll 108. Micrometer thimbles 130 are positioned so that the measuring surfaces of spindles (not shown) contact transfer support 104 to determine a minimum nip spacing between anilox roll 106 and transfer roll 108. Gear teeth 131 of transfer gear 128 extend beyond transfer roll 108, in part, so that if the proofing tool 100 is set down on a flat surface there will be a standoff created and transfer roll 108 will not touch the surface.

Anilox gear 126 and transfer gear 128 may be formed with fine pitch gear teeth to prevent gear chatter. In one aspect of the invention, the gear teeth mesh such that the gears are separated by slightly more than a true pitch diameter to allow for adjustment of nip without the need to change gears.

Optionally, proofing tool 100 may include a separation device (not shown) which can be utilized to force anilox support 102 apart from transfer support 104 a slight distance to ensure separation between anilox roll 106 and transfer roll 108 when not in use.

Proofing tool 100 may be formed substantially from aluminum alloy or from other materials known to the art.

Referring to FIGS. 5-8 proofing tool 100 includes pressure bar 134, doctor blade holder 136 and doctor blade 138. Pressure bar 134 is located at the end of yoke 122. Doctor blade holder 136 is pivotably secured to the arms of yoke 122. Doctor blade holder 136 secures doctor blade 138 by clamping or another technique known to the art. Doctor blade holder 136 has a relief cut into it, to allow positioning of the doctor blade 138 precisely parallel to anilox roll 136. Adjusting screw 140 passes through pressure bar 134 to bear on doctor blade holder 136. Adjusting screw 140 adjust the pressure of doctor blade 138 on anilox roll 106. Doctor blade holder 136 is pivotably attached to arms 116 of yoke 118.

In one embodiment of the invention, doctor blade 138 meets anilox roller 106 at approximately a 30 degree pressure angle. If the diameter of the anilox roll 106 is changed it may be necessary to change doctor blade holder 136 or to relocate the pivotable mounting of doctor blade holder 136. Alternately, the position of anilox roll 106 may be changed, for example by the use of a bushing having an eccentrically located hole therein.

Figure 5:
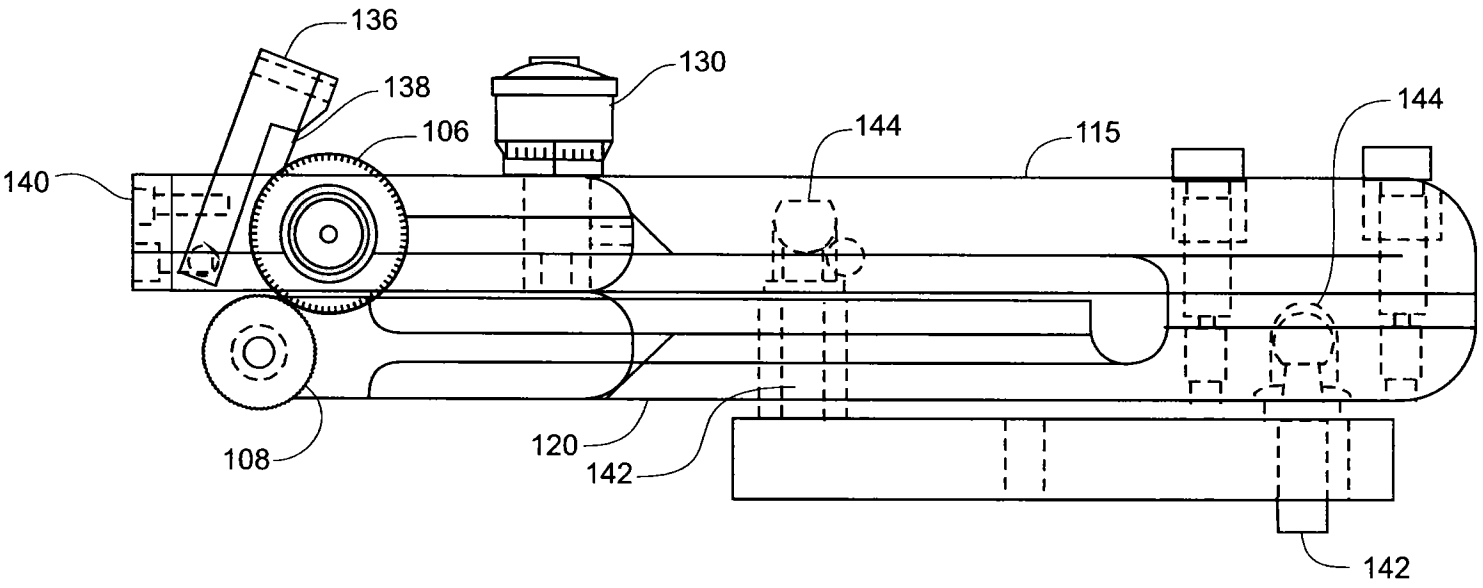
FIG. 5 is an elevational view of an embodiment of a proofing tool in accordance with the invention with some structures shown in phantom.

Still referring particularly to FIG. 5, ball ends 142 may be used to removably secure proofing tool 100 to an automated proofing machine (not shown.) If ball ends 142 are utilized, proofing tool 100 includes ball sockets 144 to receive ball ends 142 therein. Proofing tool 100 may also include one or more slide lockpins 146 located in an aperture in proofing tool 100 to secure proofing tool 100 to one or more ball ends 142 at ball sockets 144.

The orientation of the doctor blade 138 in the present invention is reversed from that in known conventional prior art proofing tools. Orientation reversal allows the optional introduction of a felt dam 147 adjacent to the doctor blade 138. The application of a felt dam 147 allows for the maintenance of a larger volume of ink in the well adjacent the doctor blade 138 which is useful, particularly, in long draw downs.

Figure 6:
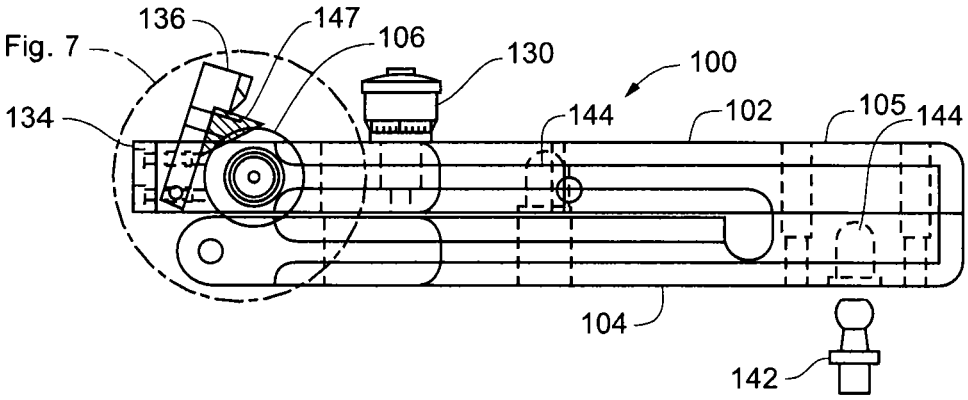
FIG. 6 is an elevational view of the proofing tool of FIG. 5 with some structures shown in phantom and some structures removed for clarity.
Figure 7:
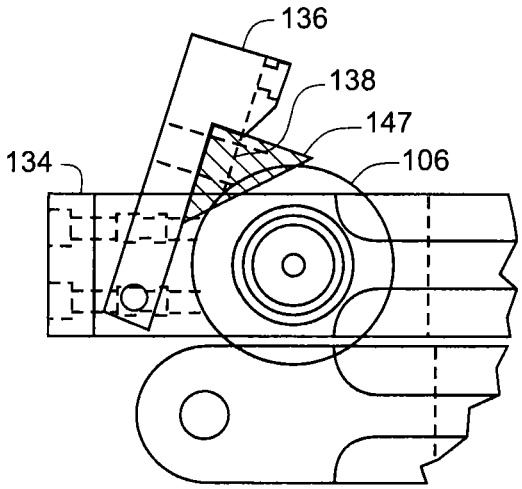
FIG. 7 is a detailed view taken from FIG. 6 with some structures shown in phantom.
Figure 8:
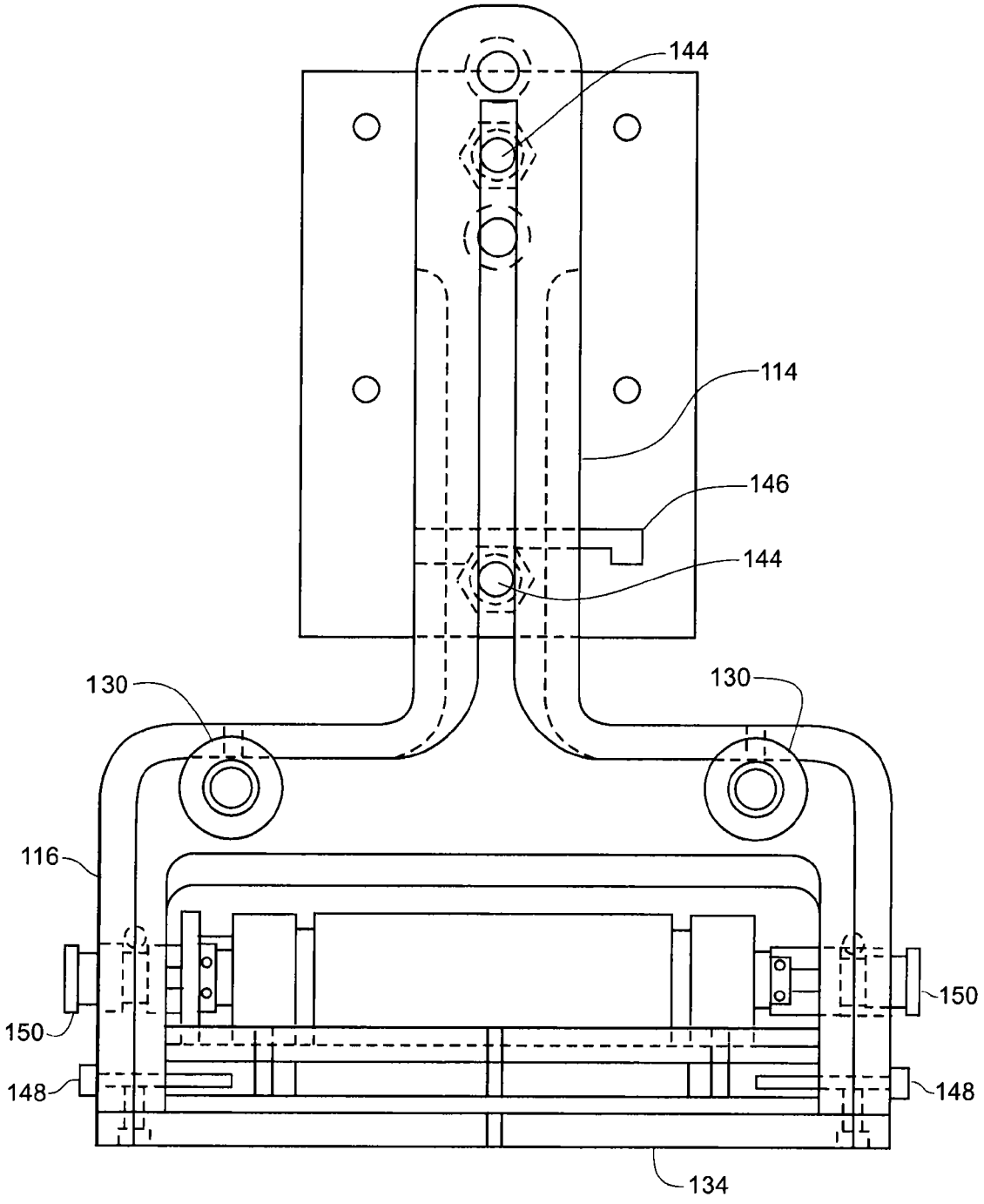
FIG. 8 is a sectional plan view of a proofing tool in accordance with the invention with some structures shown in phantom.

Referring to FIGS. 5, 6 and 8, note that extended portion 115 and extended portion 120 of anilox support 102 and transfer support 104 may be milled to thin them. The level of milling can be altered to adjust the flexibility of anilox support 102 relative to transfer support 104 allowing for adjustment of the relative flexion of anilox support 102 relative to transfer support 104.

Anilox roll 106 and transfer roll 108 may be supported in anilox support 102 by precision ball bearings, sleeve bearings or bushings. Anilox roll 106 or transfer roll 108 may be supported at a one end by fixed bearing 148 and at a second end by moveable bearing 150. One or both of anilox roll 106 or transfer roll 108 may be supported at both ends by fixed bearing 148 or by moveable bearing 150. Fixed bearing 148 and moveable bearing 150 may be, for example, Delrin bearings. Moveable bearing 150 may be adjustable so as to be loosened to remove transfer roll 108 and tightened to secure transfer roll 108 in place for use.

In another embodiment of the invention, the drive roll of a proofing machine (not shown) may include a drive roll gear 152 such that transfer gear 128 engages the drive roll gear 152 so that the drive roll gear drives transfer gear 128 which in turn drives anilox gear 126 providing a positive drive engagement between a drive roll (not shown), transfer roll 108 and anilox roll 106.

In another embodiment of the invention, proofing tool 100 may incorporate an auxiliary ink reservoir (not shown). Auxiliary ink reservoir may include a drip line and a valve to allow the institution of a steady drip supply to replenish a well of ink at doctor blade 138.

Figure 9:
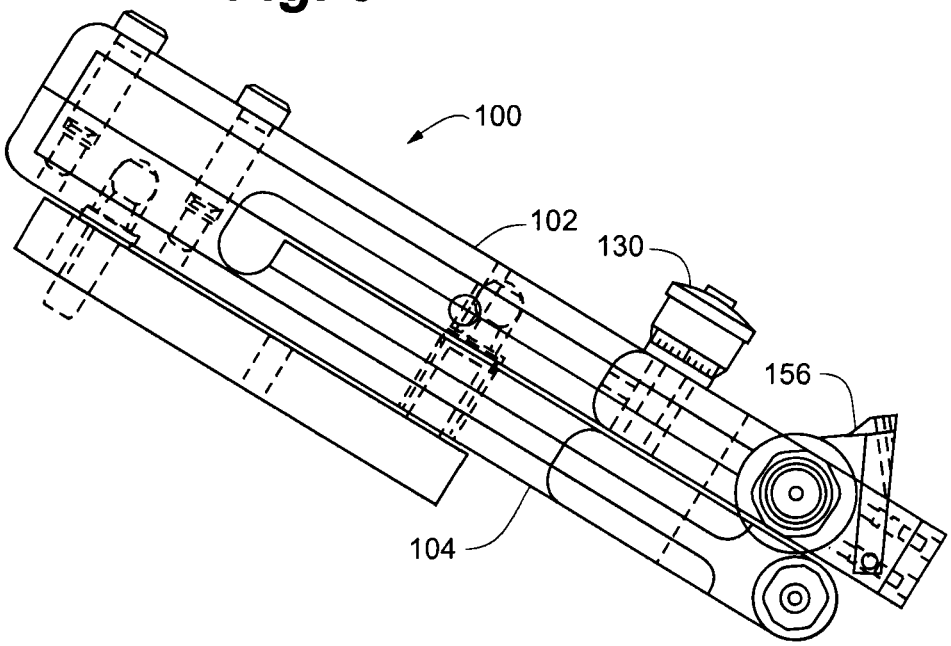
FIG. 9 is an elevational view of a proofing tool in accordance with the invention including a leading edge doctor blade with some structures shown in phantom.
Figure 10:
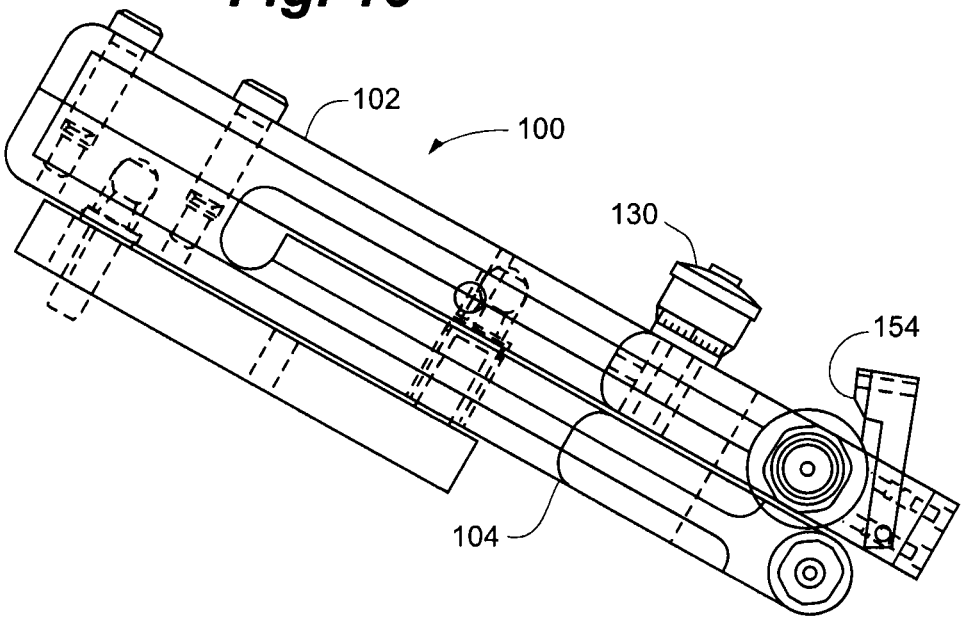
FIG. 10 is an elevational view of a proofing tool in accordance with the invention including a trailing edge doctor blade with some structures shown in phantom.

Referring to FIGS. 9 and 10, doctor blade 138 may include trailing edge doctor blade as depicted in FIG. 10 or leading edge doctor blade as depicted in FIG. 9. Trailing edge doctor blade 154 tends to force ink into anilox roll 106 while leading edge doctor blade 156 tends to meter the amount of ink by shearing off excess ink from the anilox roll 106. Another embodiment of proofing tool 100 may include both a trailing edge doctor blade 154 and a leading edge doctor blade 156 acting on a single anilox roll 106. This embodiment may be especially advantageous when proofing tool 100 is used with highly viscous inks. Highly viscous inks may tend to overwhelm the force of a trailing edge doctor blade 154 toward the anilox roll 106 and "hydroplane" the trailing edge doctor blade.

Figure 1B:
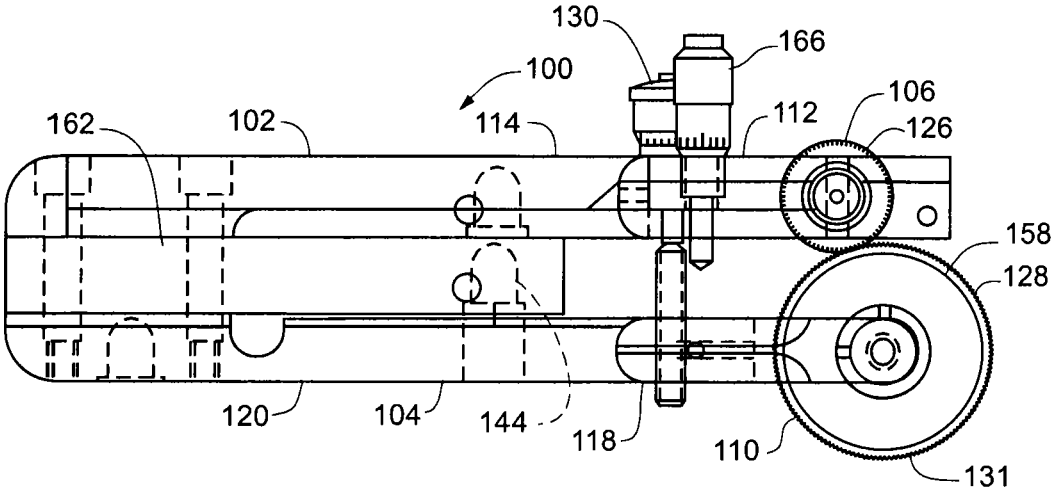
FIG. 1B is an elevational view of an embodiment of a proofing tool in accordance with the invention with some structures shown in phantom and some parts removed for clarity.
Figure 2:
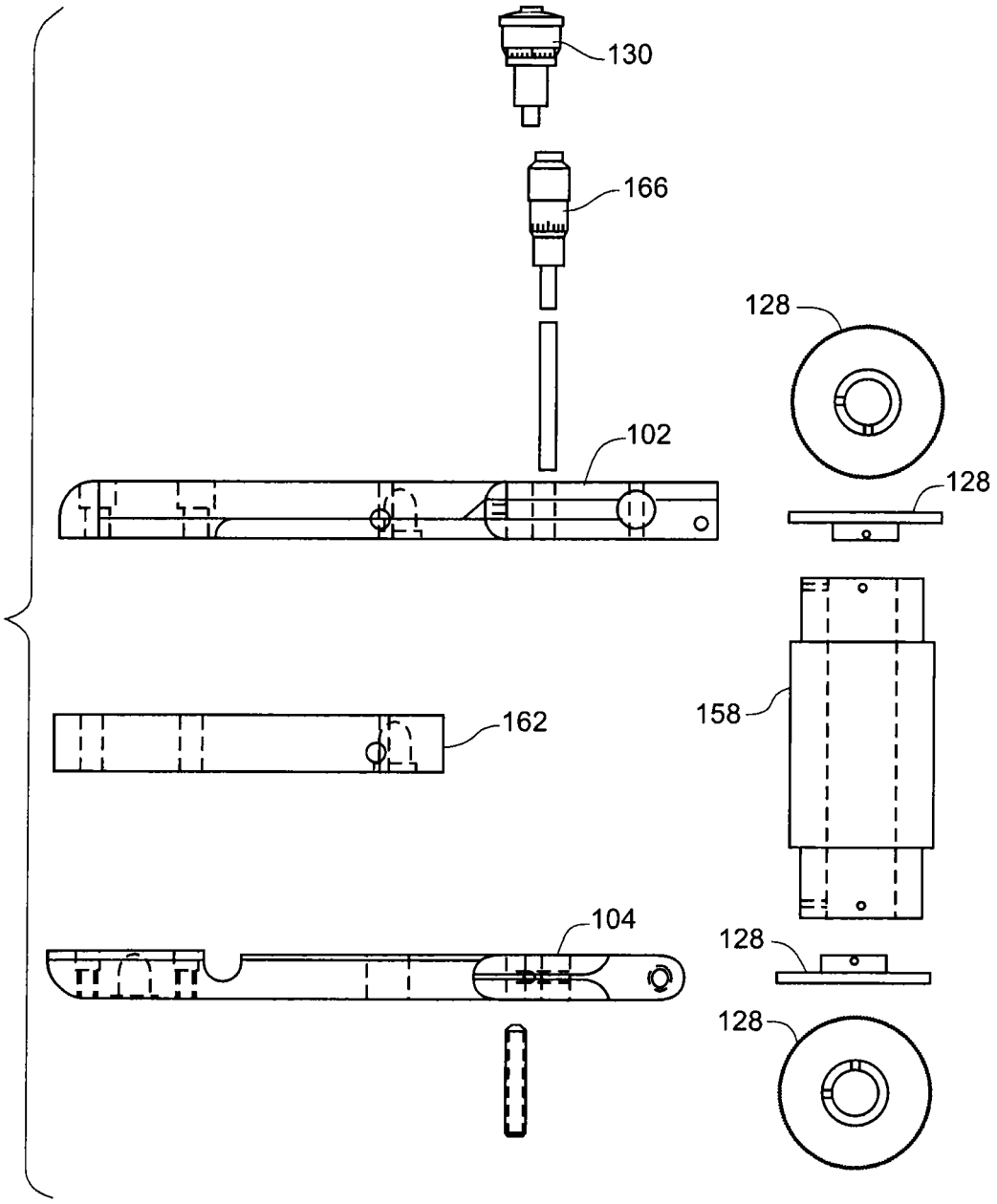
FIG. 2 is a partial exploded view of an embodiment of a proofing tool in accordance with the invention.

In an embodiment of the invention like that depicted in FIGS. 1A, 1B and 2, transfer roll 108 is replaced with cylinder 158 that is typically of larger diameter than transfer roll 108. An engraved offset printing plate 160 is attached to the cylinder, for example, by double-sided tape also known to those skilled in the art as sticky back or sticky back tape. Printing plate 160 may be formed, for example, of rubber, vinyl or metal.

Printing plate 160 may include, for example, a plate made from a photopolymer via a photopolymer printing process. Photopolymers are used in a plate making process in which a sheet of photopolymer plastic is exposed, generally with a positive image transparency via an enlargement or contact printing process. The photopolymer is then "developed" with chemicals that etch the surface of the photopolymer to make it take ink in varying degrees. The resulting printing plate 160 is then fixed with other chemicals and dried to prepare if for use in the printing process. The photopolymer plate is then used in the printing process to provide images that allow for tonal gradations when printed. Photopolymer plates can also be prepared using a laser process.

Another aspect of the present invention is that positive roll drive 110 may be used to maintain rotational integrity during proofing as in other embodiments described herein. The meshing anilox gear 126 and transfer gear 128 match the pitch velocity of anilox roll 106 with cylinder 158 bearing printing plate 160 which is also may be matched with the pitch velocity of a drum (not shown) that transports the substrate.

Cylinder 158 bearing the engraved printing plate 160 will typically be of larger diameter than transfer roll 108 described in some embodiments. For example, cylinder 158 may have a diameter of approximately 2 inches. In order to accommodate the larger diameter of cylinder 158 bearing engraved printing plate 160, spacer 162 may be used as depicted in FIGS. 1A, 1B and 2, to space anilox support 102 and transfer support 104 apart from one another. Other size cylinders may of course be used.

The larger diameter of the cylinder 158 bearing the engraved printing plate 160 provides more surface area for producing larger useable images.

Figure 11:
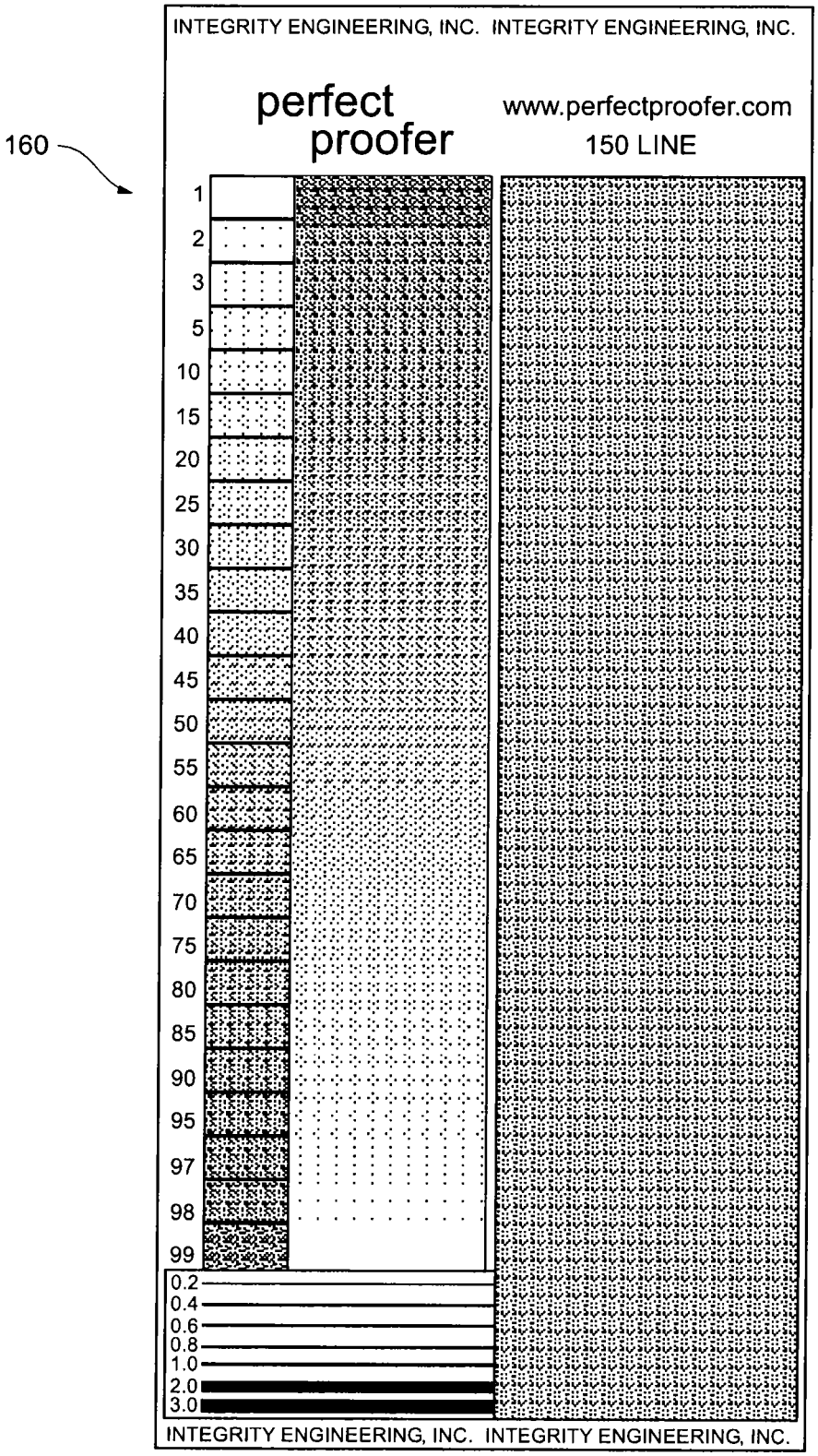
FIG. 11 depicts an example pattern for an engraved printing plate in accordance with the invention.

Printing plate 160 may have similar engraved characteristics as an engraved offset plate that will be run on a printing press. Alternately, a standard printing plate 160 may be used that includes, for example, dot patterns ranging from five to one hundred percent density as well as solid patterns. An example printing plate 160 pattern is depicted in FIG. 11.

Figure 13:
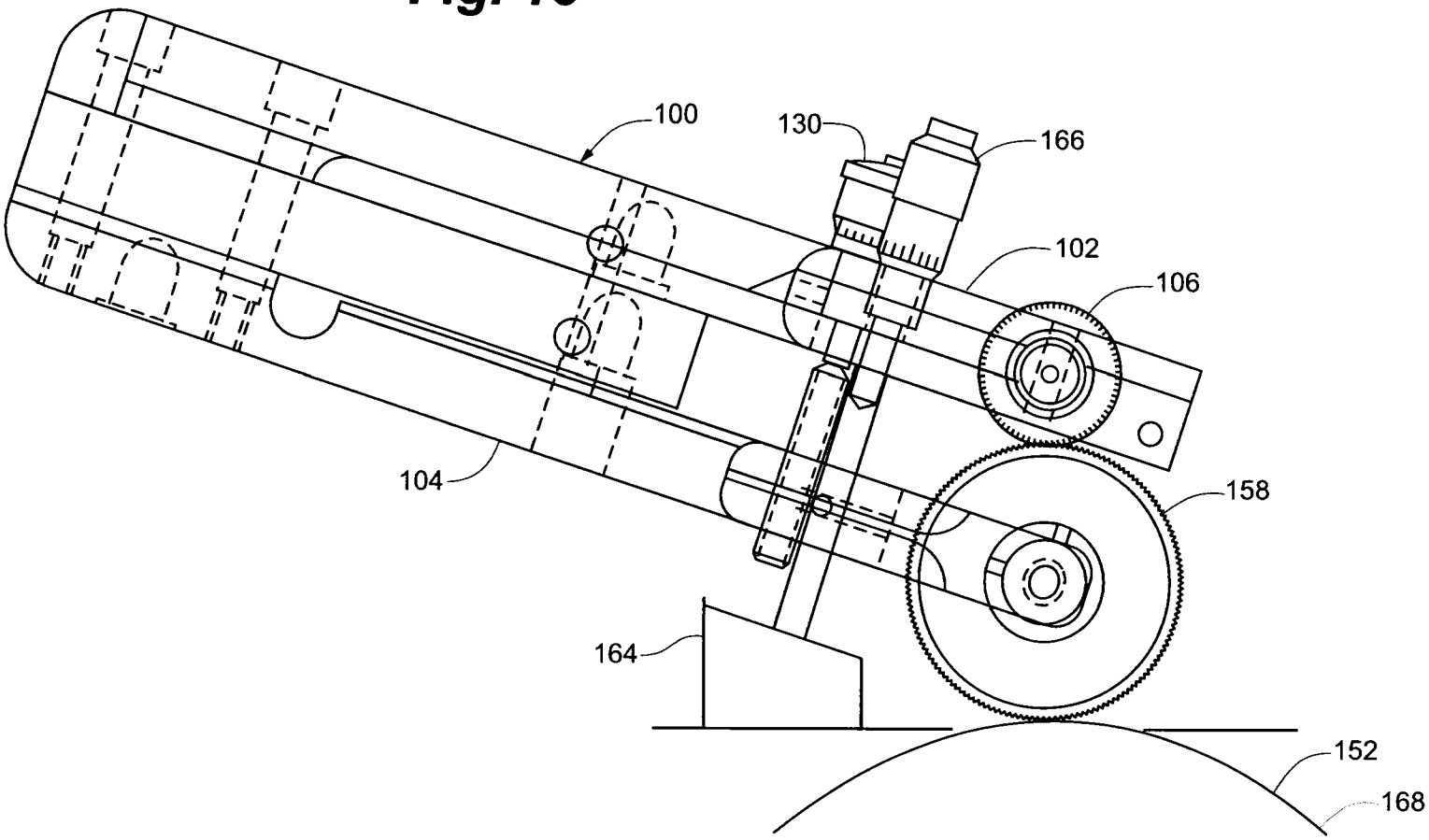
FIG. 13 is an elevational view of an embodiment of a proofing tool depicted in contact with a proofing machine and positive stops in accordance with the invention.

In another aspect of the invention, depicted in FIG. 13, positive stop 164 mounted on a proofing machine (schematically depicted in part) may be added. Positive stop 164 provides a mechanism to adjust nip or printing pressure between cylinder 158 bearing the printing plate 160 and a substrate to which printing plate 160 will be applied. When proofing tool 100 is lowered during proofing, substrate micrometer 166 engages to positive stop 164 to mechanically position proofing tool 100. Micrometers 166 may be incorporated into the structure of proofing tool 100 or the proofing machine to allow precise repeatable measurement of nip between cylinder 158 supporting printing plate 160 and drive roll 168 of the proofing machine (not shown). Substrate micrometers 166 may be adjusted. Adjustment of micrometers 166 upward will lower printing pressure by widening the nip. Adjusting micrometers 166 lower, will increase the nip pressure by narrowing the nip distance. Positive stop 164 is beneficial to control nip as the surface area of printing plate 160 changes. Without controlling the nip, the control of pressure only may cause the cylinder 158 bearing the printing plate 160 to "hump" with variations in the thickness of printing plate 160. Printing plate 160 tends to drop into low spots in the engraving where there is a reduced image offset area and create an abrupt thump when a higher portion of the offset image is encountered.

Figure 20:
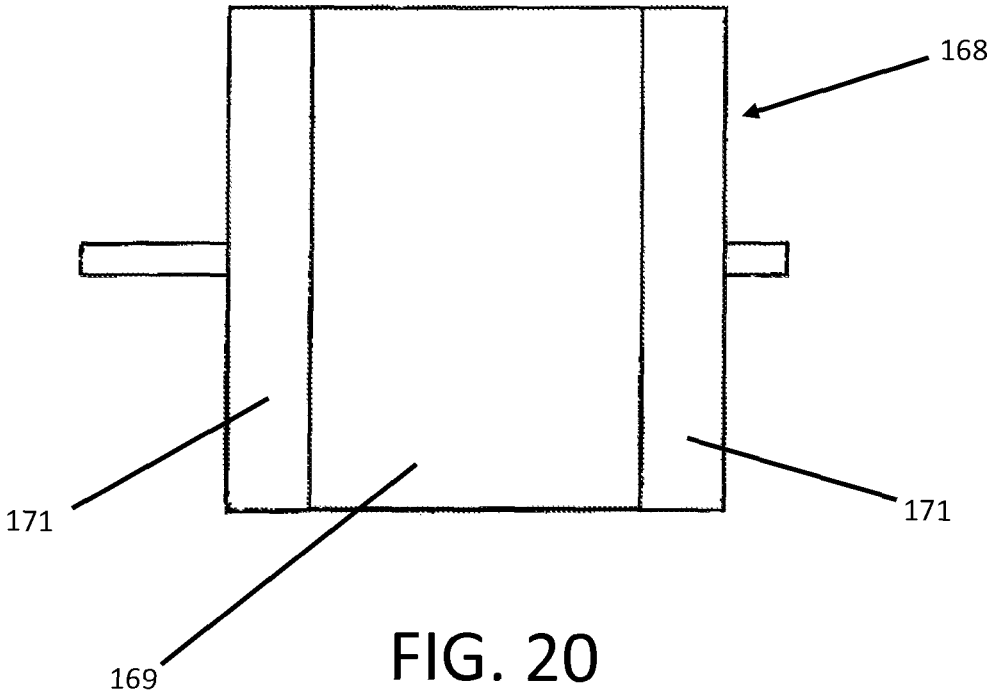
FIG. 20 is a top view of a drive roll in accordance certain embodiments of the invention.

An example embodiment of a drive roll 168 according to one example embodiment is shown in FIG. 20. The drive roll includes a polished metallic center segment surface 169 disposed between and resilient band surface segments 171 adjacent each end of the metallic center portion 169. The resilient bands may be formed of rubber, urethane or other similar material. Materials having a forty to sixty durometer measurement may be used according to one example embodiment.

A semi-positive drive is formed by the contact of the resilient band segments 171 of the drive roll 168 with the teeth of the impression roll 108 or the cylinder 158 having the plate 160 secured thereto, such as is shown in FIG. 13. Thus, there will be little or no slippage between the impression roller and the drive roller 168. This configuration allows for the use of lighter nip pressure on the plate compared to configurations where the plate must provide the traction against the drive roll in order to operate the proofing apparatus.

The present invention also includes a method of predicting the performance of a printing press for a printing job. The method includes preparing a first printing plate 160 then securing the printing plate 160 to a proofing tool 100. The proofing tool 100 is then adjusted to optimize ink transfer from anilox roll 106 to printing plate 160 and further adjusted to optimize ink transfer from printing plate 160 to a substrate. Optimization of ink transfer generally is achieved by adjusting the nip until minimum ink transfer without skipping of the image occurs across the width of the printed image. Once ink transfer is optimized an operator prepares a printing proof on a substrate and then evaluates the printing proof to predict the performance of a second printing plate 160 which is adapted for use on the printing press. This evaluation allows prediction of the performance of the second printing plate 160 on the printing press.

When the operator is evaluating printing performance the operator may measure dot gain and/or color density as well as other factors related to the printing proof. Instruments for making these measurements are known. In some embodiments of the invention, the first printing plate 160 and second printing plate 160 are prepared as a single printing plate having a first portion and a second portion that are then separated to create the first printing plate 160 and the second printing plate 160. Optionally the printing plates may be prepared separately but simultaneously or prepared to similar or identical standards to allow prediction of the performance of the printing plate 160 on the printing press.

The proofs prepared with the first printing plate 160 on proofing tool 100 may also be evaluated for the performance of sticky back adhesive which is applied between the printing plate 160 and cylinder 158 of proofing tool 100. A skilled operator can observe the results on the proof and determine whether the sticky back adhesive is too thick, too thin, too hard or too soft, too stiff or too flexible.

Referring to FIG. 11, the method may also include designing the first printing plate 160 to include a first portion that has dot images including a range that may extend from 0 to 100% dot density. The method may include designing the printing plate 160 as depicted in an example pattern in FIG. 11 to include some smaller portion of the range form 0 to 100% dot density. The invention further includes designing printing plate 160 to include a portion for testing print density. Determining print density is a way of measuring the thickness of an ink layer laid down on substrate by printing plate 160.

Based on the evaluation of the sample proof prepared with printing plate 160 it may be desired to adjust the characteristics of printing plate 160. An additional adjusted printing plate 160 may be prepared in which the adjusted printing plate 160 is adjusted relative to the first printing plate to alter dot density or print density or other characteristics. For example, the adjusted printing plate 160 may be adjusted to compensate for an undesirable dot gain by increasing or decreasing the dot density on the plate.

The present invention also includes a method of supplying a kit for predicting the performance of a printing press for a printing job. The method includes supplying or providing a proofing device including a proofing tool 100 to which a first printing plate 160 is securable and providing instructions to perform the method as outlined above.

Figure 12A:
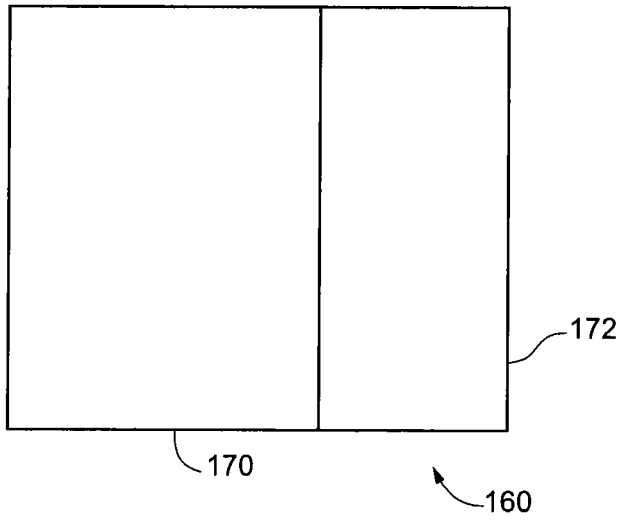
FIGS. 12A and 12B schematically depict a printing plate having a proofing portion and a printing press portion in accordance with the invention joined and separated respectively.
Figure 12B:
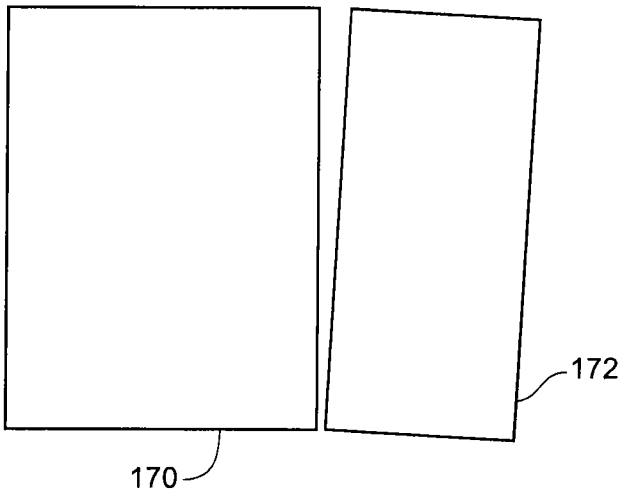

Referring to FIGS. 11 and 12, an embodiment of the invention also includes a method of preparing a printing press for a press run including creating a printing plate 160 having a printing press portion 170 that is dimensioned to be secured to a printing press and a proofing portion 172 that is dimensioned to be secured to a proofing tool. The method may also include separating the printing press portion 170 from the proofing portion 172 and applying the proofing portion 172 to the proofing tool. An operator then prepares a proof with the proofing tool and the proofing portion 172 and then uses the proof to calibrate the printing press or the ink to be used with the printing press to predict the performance of the printing press with the portion of the plate that is intended for the printing press. Some embodiments the present invention also include modifying the thickness and/or hardness of printing plate 160 as well as the thickness and/or hardness and/or flexibility of the sticky back mounting adhesive used to mount the printing plate 160.

In another embodiment of the invention the method is used to test the ink and compatibility of the ink with a particular photo polymer printing plate 160 and substrate.

In another embodiment of the invention the invention may be utilized to validate the ink photopolymer and sticky back combination for use on the printing plate to run a printing job which has previously been run. The present invention may also include a printing plate 160 for printing that includes a printing press portion 170 that is dimensioned to be secure to a printing press as well as a proofing portion 172 that is dimensioned to be secure to a proofing tool 100. The printing press portion 170 and the proofing portion 172 are separable so that the printing press portion 170 can be secured to the printing press and the proofing portion 172 can be secured to the proofing tool 100.

In another embodiment the invention includes a proofing tool 100 including an anilox roll 106 and cylinder 158 as well as a proofing printing plate 160 that is secured to cylinder 158 and which includes a portion of a printing plate 160 that includes a printing press portion 170 and a proofing portion 172 wherein the printing press portion 170 will be used to print materials that have been proofed with the proofing printing plate.

Figure 14:
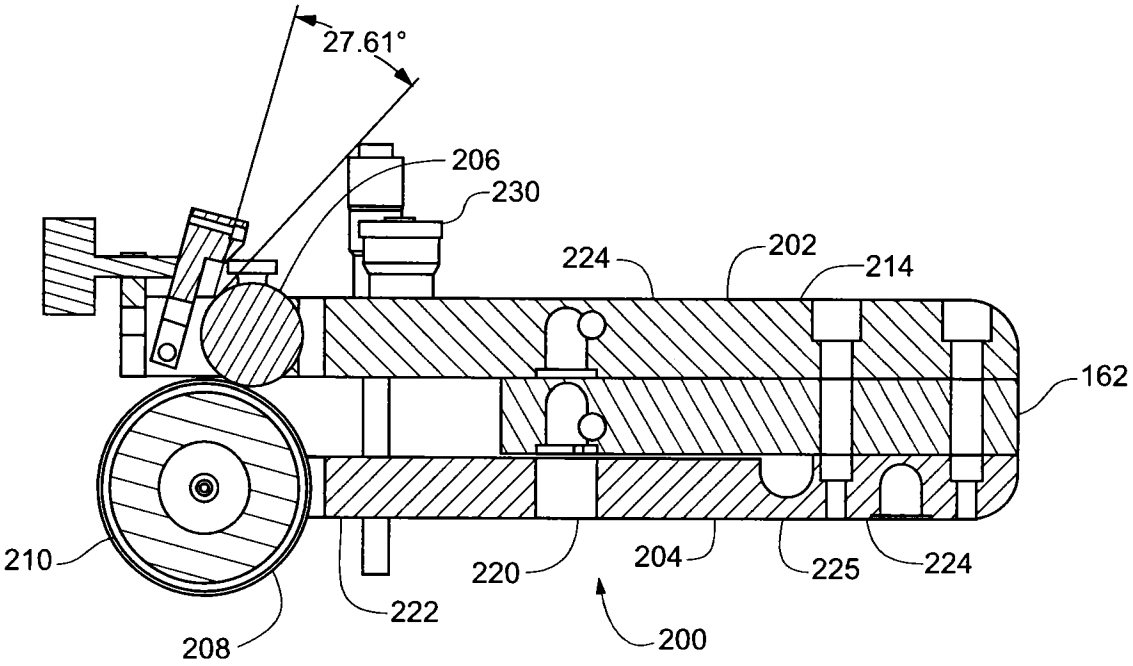
FIG. 14 is a cross sectional view of an embodiment of a proofing tool in accordance with the invention.
Figure 15:
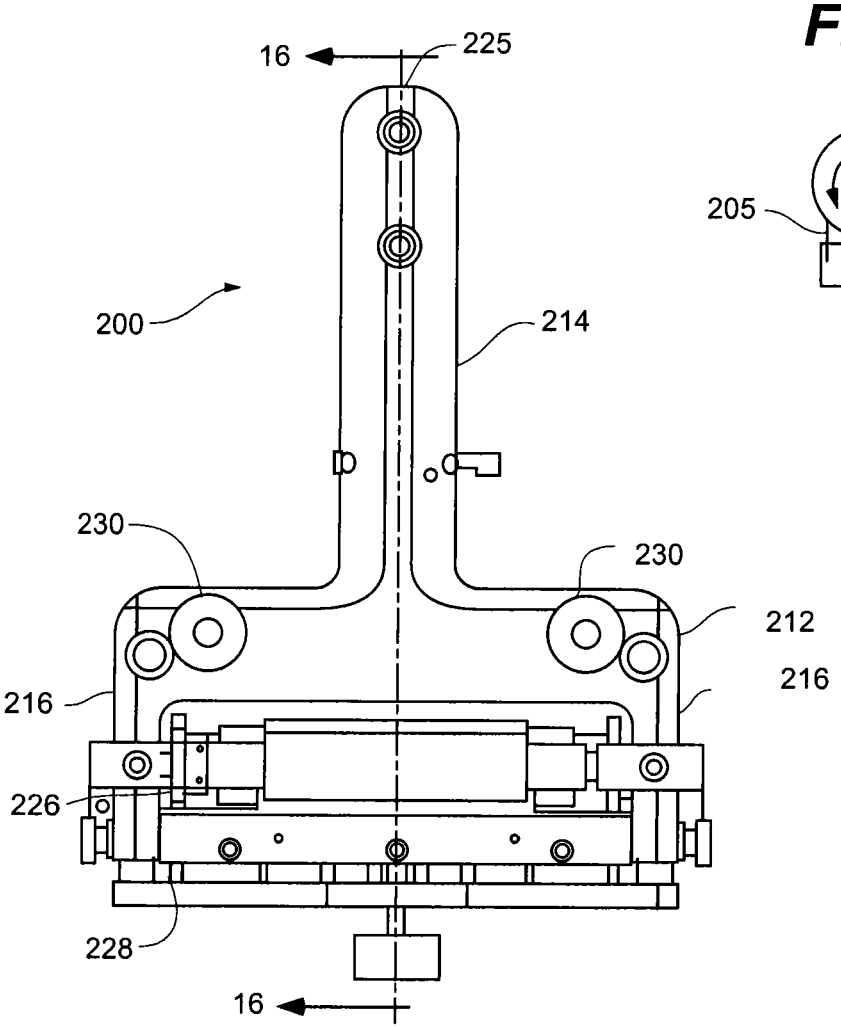
FIG. 15 is a plan view of an embodiment of a proofing tool in accordance with the invention.
Figure 16:
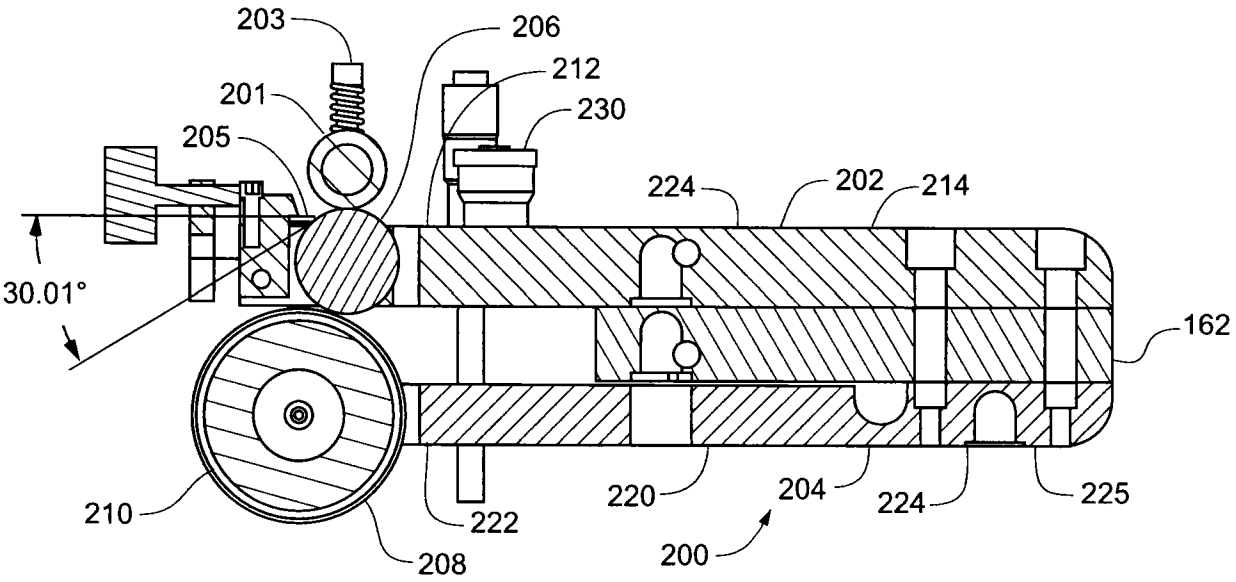
FIG. 16 is a cross sectional view of an embodiment of a proofing tool taken along section line 16-16 in accordance with the invention.

FIGS. 14-17 depict another example embodiment in accordance with the invention. Referring to FIGS. 14-16 proofing tool 200 generally includes anilox support 202, transfer support 204, anilox roll 206, transfer roll 208, positive roll drive (not shown), photopolymer plate 210, metering roll 201, and doctor blade 205. Anilox support 202 and transfer support 204 are similar but not identical structures.

Anilox support 202 generally includes yoke 212 and extended portion 214. Yoke 212 supports anilox roll 206 between two arms 216. Likewise, transfer support 204 includes yoke 222 and extended portion 224. Anilox roll 206 and transfer roll 208 are supported between the arms of yoke 212 and yoke 222 respectively. In this example embodiment, anilox support 202 and transfer support 204 are connected only at distal end 225 of extended portions 220 and 224. Otherwise, anilox support 202 and transfer support 204 are oriented substantially parallel with spacer 162 and a small gap between them. In other embodiments, anilox support 202 and transfer support 204 are connected at a location closer to anilox roll 206 and transfer roll 208. Transfer support 204 is capable of some flexing movement from a disengaged position to an engaged position such that transfer roll 208 is held, for example slightly more separated from anilox roll 206 when no force is applied to transfer roll 208 than when transfer roll is in contact with a printing substrate. Transfer support 204 can also hold transfer roll 208 in contact with anilox roll 206.

Positive roll drive 210 generally includes anilox gear 226 and transfer gear 228. Anilox gear 226 and transfer gear 228 mesh together to synchronize the motion of anilox roll 206 and transfer roll 208. In an example embodiment of the invention, there is a single set of anilox gear 226 and transfer gear 228. Another example embodiment of the invention includes one anilox gear 226 and two transfer gears 228. If one anilox gear 226 and two transfer gears 228 are present, one anilox gear 226 is located on one end of anilox roll 206 and two transfer gears 228 are located on each end of transfer roll 208 respectively. In another example embodiment, proofing tool 200 may utilize a semi positive drive in which anilox gear 226 engages a resilient surface of transfer roll 208 in a substantially non slip relationship.

Metering roll 201 is positioned adjacent anilox roll 206 and can be forced against anilox roll 206 under spring tension for example by threaded arrangement 203. Threaded arrangement 203 may be tightened or loosened as desired to control the force with which metering roll 201 contacts anilox roll 206 to adjust metering pressure. Metering roll 201 can rotate against and in contact with anilox roll 206, which forces ink into anilox roll 206 cells. A generally wedge shaped space between the metering roll 201 and anilox roll 206 forms a reservoir with adequate volume to contain sufficient ink for proofing an ink sample. Metering roll 201, in an example embodiment, has a resilient surface such as rubber or another polymer. Metering roll 201 is located above anilox roll 206 in contrast to the prior art.

Figure 17:
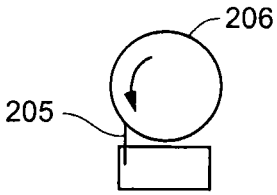
FIG. 17 is schematic view of a relationship of a leading edge doctor blade and an anilox roll in an ink proofer in accordance with the invention.

Proofing tool 200 also includes doctor blade 205. In an example embodiment, doctor blade 205 is designed to have a leading edge that shears the excess ink from the anilox roll 206. That is, doctor blade 205 is a leading edge doctor blade. FIG. 17 illustrates the interaction between the anilox roll 206 and the leading edge doctor blade 205, whereby the anilox roll 206 turns counterclockwise and the doctor blade 205 is positioned with its distal end against the surface of the anilox roll 206 to enable ink shearing. In some example embodiments, doctor blade 205 may also utilize a trailing edge configuration.

Proofing tool 200 also includes one or more micrometer thimbles 230. Two micrometer thimbles 230 may be used to allow independent adjustment to achieve equal nip spacing across the width of anilox roll 206 and transfer roll 208. In an example embodiment, micrometer thimbles 230 are positioned so that the measuring surfaces of spindles (not shown) contact transfer support 204 to determine a minimum nip spacing between anilox roll 206 and transfer roll 208. In an example embodiment, gear teeth 131 of transfer gear 228, as previously described, extend beyond transfer roll 208, in part, so that if the proofing tool 200 is set down on a flat surface there will be a standoff created and transfer roll 208 will not touch the surface.

Anilox gear 226 and transfer gear 228 may be formed with fine pitch gear teeth to prevent gear chatter. In one aspect of the invention, gear teeth 131 mesh such that Anilox gear 226 and transfer gear 228 are separated by slightly more than a true pitch diameter to allow for adjustment of nip without the need to change gears.

Optionally, proofing tool 200 may include a separation device (not shown) which can be utilized to force anilox support 202 apart from transfer support 204 a slight distance to ensure separation between anilox roll 206 and transfer roll 208 when not in use.

Proofing tool 200 may be formed substantially from aluminum alloy or from other materials known to the art.

In operation, referring to FIGS. 1 through 10, proofing tool 100 is used to prepare ink proofs for flexographic printing processes. An operator sets a nip distance between anilox roll 106 and transfer roll 108 by adjusting micrometer thimbles 130. After micrometer thimbles 130 are adjusted to a desired nip distance ink is applied between doctor blade 138 and anilox roll 106. If present, felt dam 147 is saturated with ink.

If a proof is to be hand pulled, an operator grasps proofing tool 100 by extended portion 114 and extended portion 120 and orients proofing tool 100 so that anilox roll 106 is substantially vertically above transfer roll 108. Transfer roll 108 is then brought into contact with a substrate and proofing tool 100 is drawn along the substrate. Ink is then transferred from anilox roll 106 to transfer roll 108 with the amount of ink being transferred being controlled by doctor blade 138 and the qualities of anilox roll 106. Ink from transfer roll 108 is transferred to the substrate creating an ink proof.

If proofing tool 100 is used with an ink proofing machine (not shown) proofing tool 100 is prepared for proofing in a process similar to that described above. Proofing tool 100 is then attached to proofing machine (not shown) by connecting ball sockets 144 to ball ends 142.

A substrate is inserted between transfer roll 108 or proofing tool 100 and a drive roll (not shown) of ink proofing machine (not shown).

If positive roll drive 110 is present, in one embodiment, transfer gear 128 may be engaged to a drive roll gear 152 so that as drive roll 168 rotates the drive roll gear 152 it meshes with transfer gear 128 and rotates transfer roll 106. Transfer gear 128 engages with anilox gear 126 and rotates anilox roll 106, thus preventing slippage between the drive roll (not shown), transfer roll 108, and anilox roll 106.

When proofing tool 100 is released from contact with the substrate, anilox roll 106 and transfer roll 108 may be separated by the resiliency of extended portion 120 and extended portion 124.

In operation, referring to FIGS. 14-17, proofing tool 200 is used to prepare ink proofs for flexographic printing processes. An operator sets a nip distance between anilox roll 206 and transfer roll 208 covered by photopolymer plate 210 by adjusting micrometer thimbles 230. An operator also sets metering tension by adjusting threaded arrangement 203, which increases or reduces force, as desired, against metering roll 201. After micrometer thimbles 230 and threaded arrangement 203 are adjusted, ink is applied at the juncture between metering roll 201 and anilox roll 206.

If a proof is to be hand pulled, an operator grasps proofing tool 200 by extended portion 214 and extended portion 220 and orients proofing tool 200 so that anilox roll 206 is substantially vertically above transfer roll 208 and metering roll 201 is above anilox roll 206.

Transfer roll 208 is then brought into contact with a substrate and proofing tool 200 is drawn along the substrate. Ink is pressed into cells of anilox roll 206 by metering roll 201. Ink is then transferred from anilox roll 206 to transfer roll 208 with the amount of ink being transferred being controlled by doctor blade 205 which shears off excess ink from anilox roll 206 and the qualities of anilox roll 206. Ink from transfer roll 208 is transferred from photopolymer plate 210 to the substrate creating an ink proof.

This operation is substantially different than that of a press. In proofing tool 200, metering roll 201 is gravitationally above anilox roll 206 and ink is held in the nip between metering roll 201 and anilox roll 206 by the inherent viscosity and surface tension of the ink. In a press, the metering roll is gravitationally below the anilox roll, where the metering roll rotates in an ink bath and lifts ink upward to the anilox roll. It follows then, that doctor blade 205 in proofing tool 200 is functionally different as well. In proofing tool 200, leading edge doctor blade 205 shears excess ink away from anilox roll 206 at a location above the center of rotation of anilox roll 206.

Trailing edge doctor blades 154 act to both force ink into the anilox roll cells, and to remove excess ink. Because of its trailing edge positioning and dual role, over time, ink particulates can build up on the back of trailing edge doctor blade 154. This results in a less efficient metering of ink and less accurate prediction of ink and plate performance on the press. It has been observed that when a sufficient quantity of ink particulate accumulate behind trailing edge doctor blade 154 the force with which trailing edge doctor blade 154 is against anilox roll 206 is overcome and an undesired excess quantity of ink is released. The excess quantity of ink is transferred to transfer roll 108 or photopolymer plate 210 and an area of increased color density is created on the substrate.

EXAMPLE

Figure 18:
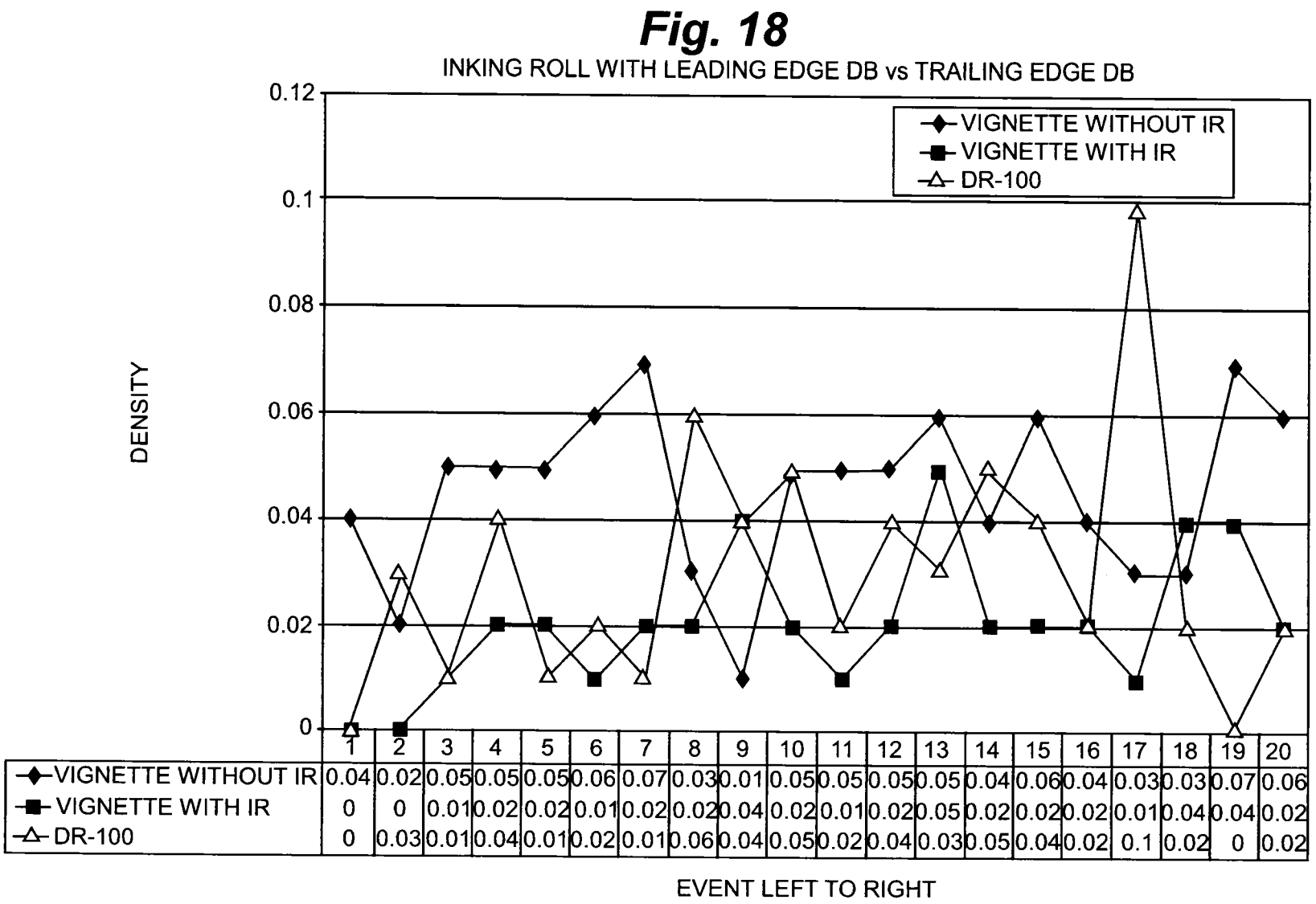
FIG. 18 is an example graph comparing measured ink color density at various locations on a proof.

FIG. 18 illustrates the results of an experiment that tested several kinds of proofers, including those with both trailing and leading edge doctor blades, and measured the density of ink left on a substrate measured at twenty locations. The line depicted with a diamonds, labeled "Vignette Without IR," is a proofer with a leading edge doctor blade and no metering or ink roll. The line depicted with a squares, labeled "Vignette With IR," is the proofer identified herein as proofer 200; a proofer with a leading edge doctor blade and an ink roll as described herein. The line depicted with a triangle, labeled "DR-100," is a conventional proofing tool implementing a trailing edge doctor blade. Even a casual glance at the chart evidences the fact that the leading edge doctor blade with ink roll, the embodiment described in proofer 200, has fewer and less extreme peaks and valleys than either of the other proofers, thus demonstrating its improved consistency.

FIG. 19 is a table of the density measurements and standard deviation calculations for the three proofers described above, as well as the printing press "Dot Pattern Mark Andy Press," an industry standard flexographic printing press. Specifically, the table shows the inputs into the standard deviation calculation; the twenty inking measurements tested and graphed in FIG. 18. In this case, standard deviation of ink density can be thought of as a reflection of inking consistency or ink density over the length of a proof drawdown on a substrate. The chart shows that an embodiment of proofer 200, with a standard deviation of 0.013168943, is not only more consistent than conventional proofers (0.016026294 and 0.023502519 standard deviations, respectively), but also more consistent than an industry standard printing press (0.015652476 standard deviation).

The present invention may be embodied in other specific forms without departing from the spirit of any of the essential attributes thereof; therefore, the illustrated embodiments should be considered in all respects as illustrative and not restrictive, reference being made to the appended claims rather than to the foregoing description to indicate the scope of the invention.

What is claimed is:

1. A method of proofing ink before application of the ink to a flexographic printing press, the method comprising:

mounting a photopolymer plate on an impression roll coupled to a hand holdable support member, the photopolymer plate including an etched surface;

supplying the ink to be proofed to an anilox roll coupled to the hand holdable support member;

transferring ink from the anilox roll to an etched surface of the photopolymer plate mounted on the transfer roll;

generating an ink proof image on an ink receiving substrate, the ink proof image corresponding to the etched surface of the photopolymer plate;

measuring a dot gain value of the ink proof image; and adjusting a minimum nip distance defined between the etched surface of the photopolymer plate and the ink receiving substrate to alter an ink density property for a future ink proof image.

2. The method of claim 1, wherein the step of setting of the minimum nip distance includes operating an adjustment device coupled to the hand holdable support member.

3. The method of claim 1, wherein the photopolymer plate is configured for a desired dot gain range, the method further comprising repeating the steps of forming the ink proof image and measuring the dot gain value of the ink proof image to confirm that the measured dot gain is in the desired dot gain range.

4. The method of claim 1, further comprising shearing the ink from the anilox roll with a leading edge doctor blade.

5. The method of claim 1, further comprising wiping the ink from the anilox roll with a trailing edge doctor blade.

6. The method of claim 1, further comprising both shearing the ink from the anilox roll with a leading edge doctor blade and wiping the ink from the anilox roll with a trailing edge doctor blade.

7. The method of claim 1, wherein the photopolymer plate includes a dot pattern etching defining a dot pattern range extending from 0% to 100% dot density.

8. A pre-press ink proofing system for generating ink proof images on an ink receiving substrate, the system comprising:

an impression roll coupled to a hand holdable support member, the impression roll defining a plate supporting outer circumferential surface, a first longitudinal end and a second longitudinal end;

a first drive wheel disposed on the first longitudinal end of the impression roll;

a photopolymer printing plate disposed on the plate supporting outer circumferential surface, the photopolymer printing plate including an etched outer surface facing away from the impression roll, the plate defining a longitudinal width; and a drive roll disposed proximate to the impression roll, the drive roll including a first non-metallic gear engagement portion disposed on a first side of an ink receiving substrate support surface segment, wherein the first drive wheel contacts the first gear engagement portion of the drive roll to impart rotation to the impression roll as the drive roll rotates while the printing plate is disposed on the outer circumferential surface of the impression roll, and wherein a longitudinal width of the ink receiving substrate support surface segment is equal to or greater than the longitudinal width of the printing plate.

9. The ink proofing system of claim 8, further comprising an adjustment device coupled to the hand holdable support member and located relative to the central ink receiving substrate support surface segment such that the adjustment device can set a fixed nip between the etched surface of the printing plate and the ink-receiving substrate.

10. The ink proofing system of claim 8, wherein the drive roll further includes a second non-metallic gear engagement portion disposed on a second side of an ink receiving substrate, the second side separated from the first side by the ink receiving substrate support surface segment, the system further comprising a second drive wheel disposed on the second longitudinal end of the impression roll, wherein the second drive wheel contacts the first gear engagement portion of the drive roll to impart rotation to the impression roll as the drive roll rotates while the printing plate is disposed on the outer circumferential surface of the impression roll.

* * * * *